US007823650B2

(12) United States Patent
Eckholm et al.

(10) Patent No.: US 7,823,650 B2
(45) Date of Patent: Nov. 2, 2010

(54) METHODS AND APPARATUS FOR HAZARD CONTROL

(75) Inventors: William A. Eckholm, Scottsdale, AZ (US); Lee Seebaluck, Wake Forest, NC (US)

(73) Assignee: Firetrace USA, LLC, Scottsdale, AZ (US)

( * ) Notice: Subject to any disclaimer, the term of this patent is extended or adjusted under 35 U.S.C. 154(b) by 194 days.

(21) Appl. No.: 12/172,148

(22) Filed: Jul. 11, 2008
(Under 37 CFR 1.47)

(65) Prior Publication Data

US 2009/0178813 A1 Jul. 16, 2009

(51) Int. Cl.

| | |
|---|---|
| ***A62C 37/36*** | (2006.01) |
| ***A62C 35/64*** | (2006.01) |
| ***A62C 35/13*** | (2006.01) |
| ***A62C 35/11*** | (2006.01) |
| ***A62C 35/62*** | (2006.01) |
| ***A62C 35/00*** | (2006.01) |
| ***A62C 37/10*** | (2006.01) |

(52) U.S. Cl. ..... 169/20; 169/17; 169/46; 169/60; 169/61

(58) Field of Classification Search ..... 169/16, 169/17, 19, 20, 23, 46, 56, 60, 61
See application file for complete search history.

(56) References Cited

U.S. PATENT DOCUMENTS 4,356,868 A 11/1982 Bentley et al.
4,650,003 A * 3/1987 Euson ..... 169/60
5,954,138 A 9/1999 Gabriel
2002/0121381 A1* 9/2002 Reilly ..... 169/14

OTHER PUBLICATIONS

David M. Gray, Fire Protection Moves "Inside the Box," Firewatch! Mar. 2003, pp. 24-25.t.

William A. Eckholm, Fire Protection for Cabinets and Enclosures, Fire-Suppression & Protection, Airport Technology International.

David Gray, An Automatic Fire-Suppression System for the Laboratory, reprinted from American Laboratory News, Jan. 2002.

Fire Protection Solutions; CNC Machines, Firetrace Automatic Fire Suppression Systems Brochure.

It's Time to Start Thinking "Inside" the Box!, Firetrace Automatic Fire Suppression Systems Brochure, NFPA World Safety Conference and Exposition, May 2004, Salt Lake City, Utah.

(Continued)

*Primary Examiner*—Darren W Gorman
(74) *Attorney, Agent, or Firm*—The Noblitt Group, PLLC

(57) ABSTRACT

A hazard control system according to various aspects of the present invention is configured to deliver a control material in response to detection of a hazard. In one embodiment, the hazard control system comprises a pressure tube having an internal pressure and configured to leak in response to exposure to heat. The leak changes the internal pressure and generates a pneumatic signal. A fire detector may also detect a fire condition associated with fire. A valve may be coupled to the fire detector and the pressure tube. The valve is configured to change the internal pressure and generate the pneumatic signal in response to a signal from the fire detector. The pneumatic signal triggers a delivery system to deliver the control material.

18 Claims, 4 Drawing Sheets

OTHER PUBLICATIONS

Fire Protection: The Impossible is Now Possible?, North American Windpower, May 2005.
Technical Member Profile: Firetrace International, Production Machining, Aug. 2005, p. 18.
Fire Protection: The Impossible is Now Possible!, advertisement in Renewable Energy World, Jul.-Aug. 2004, p. 14.
Protecting Your Micro-Environment, Firetrace Automatic Fire Suppression Systems Brochure.

* cited by examiner

METHODS AND APPARATUS FOR HAZARD CONTROL

BACKGROUND OF THE INVENTION

Hazard control systems often consist of a smoke detector, a control board, and extinguishing system. When the smoke detector detects smoke, it sends a signal to the control board. The control board then typically sounds an alarm and triggers the extinguishing system in the area monitored by the smoke detector. Such systems, however, are complex and require significant installation time and cost. In addition, such systems may be susceptible to failure in the event of malfunction or loss of power.

SUMMARY OF THE INVENTION

A hazard control system according to various aspects of the present invention is configured to deliver a control material in response to detection of a hazard. In one embodiment, the hazard control system comprises a pressure tube having an internal pressure and configured to leak in response to exposure to heat. The leak changes the internal pressure and generates a pneumatic signal. A fire detector may also detect a fire condition associated with fire. A valve may be coupled to the fire detector and the pressure tube. The valve is configured to change the internal pressure and generate the pneumatic signal in response to a signal from the fire detector. The pneumatic signal triggers a delivery system to deliver the control material.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various vessels, sensors, detectors, control materials, valves, and the like, which may carry out a variety of functions. In addition, the present invention may be practiced in conjunction with any number of hazards, and the system described is merely one exemplary application for the invention. Further, the present invention may employ any number of conventional techniques for delivering control materials, sensing hazard conditions, controlling valves, and the like.

Figure 1:
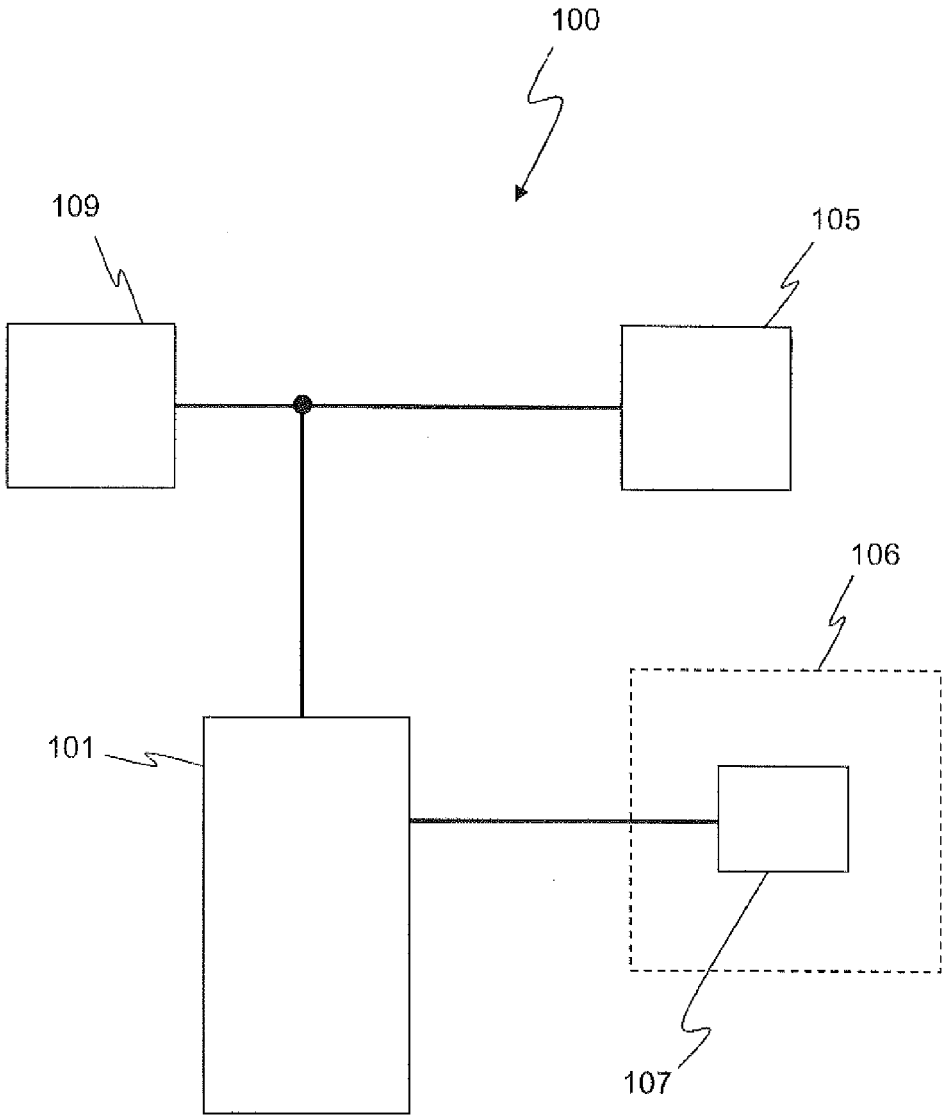
FIG. 1 is a block diagram of a hazard control system according to various aspects of the present invention.
Figure 2:
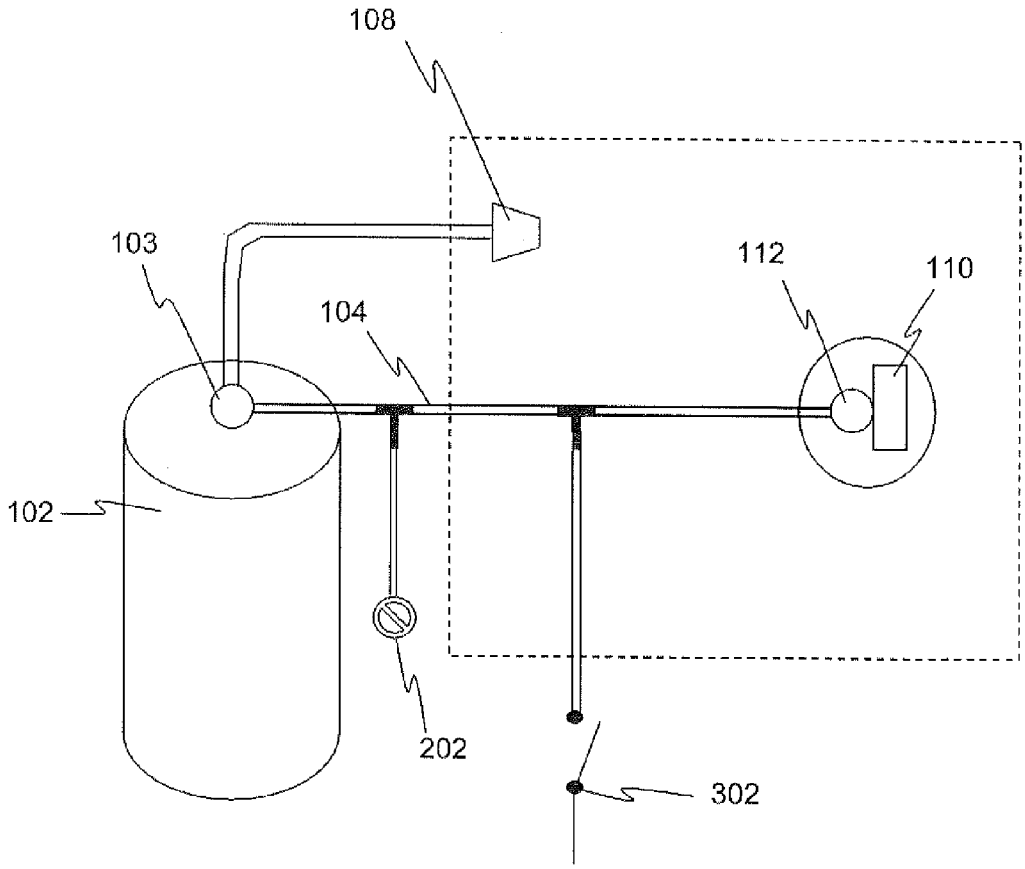
FIG. 2 representatively illustrates an embodiment of the hazard control system.

Referring now to FIGS. 1 and 2, a hazard control system 100 for controlling a hazard according to various aspects of the present invention may comprise a control material source 101 for providing a control material, for example an extinguishant for extinguishing a fire. The hazard control system 100 may further comprise a hazard detection system 105 for detecting one or more hazards, such a smoke detector, radiation detector, thermal sensor, or gas sensor. The hazard control system 100 further comprises a delivery system 107, such as a nozzle 108 coupled to a vessel 102, to deliver the control material to a hazard area 106 in response to the hazard detection system 105.

The hazard area 106 is an area that may experience a hazard to be controlled by the hazard control system 100. For example, the hazard area 106 may comprise the interior of a cabinet, device, vehicle, enclosure, and/or other area. Alternatively, the hazard area may comprise an open area that may be affected by the hazard control system 100.

The control material source 101 may comprise any appropriate source of control material, such as a storage facility containing a control material. Referring to FIG. 2, the source of control material may comprise a vessel 102 configured to store a control material for controlling a hazard. The control material may configured to neutralize or combat one or more hazards, such as a fire extinguishant or acid neutralizer. The vessel 102 may comprise any suitable system for storing and/or providing the control material, such as a tank, pressurized bottle, reservoir, or other container. The vessel 102 may be configured to withstand various operating conditions. The vessel 102 may comprise various materials, shapes, dimensions, and coatings according to any appropriate criteria, such as corrosion, cost, deformation, fracture, and/or the like.

The vessel 102 and the control material may be adapted according the particular hazard and/or environment. For example, if the hazard control system 100 is configured to control a hazard area 106 such that the hazard area 106 maintains a low oxygen level, the vessel 102 may be configured to provide a control material which absorbs or dilutes oxygen levels when transmitted into the hazard area 106. As another example, if the hazard control system 100 is configured to control a hazard area 106 such that equipment within hazard area 106 is substantially protected from thermal radiation, the vessel 102 may be configured to provide an extinguishant which absorbs thermal radiation when transmitted into the hazard area 106.

The delivery system 107 is configured to deliver the control material to the hazard area 106. The delivery system 107 may comprise any appropriate system for delivering the control material. In the present embodiment, the delivery system 107 may include a nozzle 108 connected to the vessel 102 and disposed in or adjacent to the hazard area 106 such that control material exiting the nozzle 108 is deposited in the hazard area 106. For example, if a fire is detected in the hazard area 106, a fire extinguishant is transmitted from the vessel 102 through the nozzle 108 to the hazard area 106 to extinguish the fire.

The nozzle 108 may be connected directly or indirectly to the vessel 102 to deliver the control material. For example, the nozzle 108 may be indirectly connected to the vessel 102 via a deployment valve 103, which controls deployment of the control material through the nozzle 108. The deployment valve 103 controls whether and, if desired, the amount or type of control material delivered through the nozzle 108. The deployment valve 103 may comprise any appropriate mechanism for selectively providing the control material for deployment via the nozzle 108, such as a ball cock, a ball valve, a bibcock, a blast valve, a butterfly valve, a check valve, a double check valve, an electromechanical diaphragm, an electromechanical screw, an electromechanical switch, a freeze valve, a gate valve, a globe valve, a hydraulic valve, a leaf valve, a non-return valve, a pilot valve, a piston valve, a plug valve, a pneumatic valve, a Presta valve, a rotary valve, a Shrader valve, a solenoid valve, and/or the like. In the present embodiment, the deployment valve 103 responds to a signal, for example a pneumatic signal from the hazard detection system 105, and controls delivery of the extinguishant via the nozzle 108 accordingly.

The hazard detection system 105 generates a hazard signal in response to a detected hazard. The hazard detection system 105 may comprise any appropriate system for detecting one or more specific hazards and generating a corresponding signal, such as system for detecting smoke, heat, poison, radiation, and the like. In the present embodiment, the hazard detection system 105 is configured to detect a fire and provide a corresponding signal to the deployment valve 103. The hazard signal may comprise any appropriate signal for transmitting relevant information, such as an electrical pulse or signal, acoustic signal, mechanical signal, wireless signal, pneumatic signal, and the like. In the present embodiment, the hazard signal comprises a pneumatic signal generated in response to detection of the hazard condition and provided to the deployment valve 103, which delivers the extinguishant in response to the signal. The hazard detection system 105 may generate the hazard signal in any suitable manner, for example in conjunction with conventional hazard, such as a smoke detector, fusible link, infrared detector, radiation detector, or other suitable sensor. The hazard detection system 105 detects one or more hazards and generates (or terminates) a corresponding signal.

In the present embodiment, the hazard detection system 105 includes a pressure tube 104 configured to generate a signal in response to a change in pressure in the pressure tube 104. The hazard detection system may further comprise a hazard detector, such as a fire detector 110, configured to release the pressure in the pressure tube 104 upon detecting a hazard condition, for example via a valve 112 connected to the pressure tube 104.

In the present embodiment, the hazard detection system 105 generates the pneumatic signal by changing pressure in the pressure tube 104, such as by releasing the pressure in the pressure tube 104. The pressure tube 104 may operate with a higher or lower internal pressure than ambient pressure. Equalizing the internal pressure with the ambient pressure generates the pneumatic hazard signal. The internal pressure may be achieved and sustained in any suitable manner, for example by pressurizing and sealing the pressure tube 104, connecting the tube to an independent pressure source such as a compressor or pressure bottle, or connecting the pressure tube 104 to the vessel 102 having a pressurized fluid. Any fluid that may be configured to. transmit a change in pressure within the pressure tube 104 may be used. For example, a substantially incompressible fluid such as a water-based fluid may be sensitive to changes in temperature and/or changes in the internal volume of the pressure tube 104 sufficient to signal coupled devices in response to a change in pressure. As another example, a substantially inert fluid such as air, nitrogen, or argon may be sensitive to changes in temperature and/or changes in the internal volume of the pressure tube 104 sufficient to signal coupled devices in response to a change in pressure. The pressure tube 104 may comprise appropriate materials, including Firetrace™ detection tubing, aluminum, aluminum alloy, cement, ceramic, copper, copper alloy, composites, iron, iron alloy, nickel, nickel alloy, organic materials, polymer, titanium, titanium alloy, rubber, and/or the like. The pressure tube 104 may be configured according to any appropriate shapes, dimensions, materials, and coatings according to desired design considerations such as corrosion, cost, deformation, fracture, combinations, and/or the like.

The pressure changes within the pressure tube 104 may occur based on any cause or condition. For example, the pressure in the tube may change in response to a release of pressure in the pressure tube 104, for example due to actuation of the pressure control valve 112. Alternatively, pressure changes may be caused by changes in the temperature or volume of the fluid in the pressure tube 104, for example in response to actuation of the pressure control valve 112 or a heat transfer system. In the present embodiment, changes in tube pressure may be induced by multiple mechanisms. For example, the pressure tube 104 may be configured to degrade and leak in response to a hazard condition, such as puncture, rupture, deformation, exposure to fire-induced heat, corrosion, radiation, acoustic pressure, changed ambient pressure, particular solids or fluids, mechanical changes such as a change in the tensile properties or configuration of a coupled sacrificial element, and/or the like. Upon degradation, the pressure tube 104 loses pressure, thus generating the pneumatic signal.

In addition, the hazard detection system 105 may include external systems configured to activate the hazard control system 100. Various hazards produce various hazard conditions, which may be detected by the hazard detection system 105. For example, fires produce heat and smoke, which may be detected by the fire detector 110, causing the fire detector 110 to activate delivery of the control material.

In the present embodiment, other systems may control the pressure in the pressure tube 104, such as via the pressure control valve 112. For example, the pressure control valve 112 may be configured to affect pressure within the pressure tube 104 in response to signals from another element, such as the fire detector 110. The affected pressure may be achieved by configuring the pressure control valve 112 to selectively change the pressure within the pressure tube 104, substantially equalize the pressure within the pressure tube 104 to outside the pressure tube 104, change the temperature of the fluid within the pressure tube 104, and/or the like. In the present embodiment, the fire detector 110 opens the pressure control valve 112 upon detecting a fire, thus allowing the pressure in the pressure tube 104 to escape and generate the pneumatic signal.

The pressure control valve 112 may comprise any suitable mechanism for controlling the pressure in the pressure tube 104, such as a ball cock, a ball valve, a bibcock, a blast valve, a butterfly valve, a check valve, a double check valve, an electromechanical diaphragm, an electromechanical screw, an electromechanical switch, a freeze valve, a gate valve, a globe valve, a hydraulic valve, a leaf valve, a non-return valve, a pilot valve, a piston valve, a plug valve, a pneumatic valve, a Presta valve, a rotary valve, a Shrader valve, a solenoid valve, and/or the like. in the present embodiment, the pressure control valve 112 comprises an electromechanical system coupled to a power source, for example a landline power source, a battery, and/or the like. In the present embodiment, the pressure control valve 112 comprises a solenoid configured for operation at between about 12 and 24 volts. The pressure control valve 112 may be configured to achieve various changes in pressure within the pressure tube 104 by varying the choice of materials, dimensions, power consumption, and/or the like.

The pressure control valve 112 may be controlled by any suitable systems to change the pressure in the pressure tube 104 in response to a trigger event. For example, the hazard detection system 105 may be configured to detect various hazardous conditions that may constitute trigger events. In the present embodiment, the fire detector 110 may detect conditions associated with fires. The fire detector 110 may be replaced or supplemented with detectors of other hazards, such as sensors sensitive to incidence with selected substances, radiation levels and/or frequencies, pressures, acoustic pressures, temperatures, tensile properties of a coupled sacrificial element, and/or the like. The fire detector 110 suitably comprises a conventional electronic system for fire detection, such as an ionization detector, a mass spectrometer, an optical detector, and/or the like. The fire detector 110 receives power from one or more sources, such as a landline power connection, a battery, and/or the like.

The hazard detection system 105 may control the pressure control valve 112 via any suitable signals, such as electrical signals transmitted via a wire, radio waves, magnetic signals as by an electromagnet, mechanical interaction, infrared signals, acoustic signals, and/or the like. In the present embodiment, the fire detector 110 and pressure control valve 112 are configured such that, upon detection of a fire condition, the fire detector 110 transmits an electrical signal to the pressure control valve 112, which responds by changing the pressure within the pressure tube 104, in particular by opening the pressure control valve 112 to release the pressure.

The fire detector 110, pressure tube 104, and/or other elements of the hazard detection system 105 may be configured for any variety of fire or other hazard conditions. For example, the hazard detection system 105 may monitor for a single hazard condition, such as heat. In this configuration, the pressure tube 104 and fire detector 110 serve as substantially independent detection systems of the same hazard condition. Alternatively, the hazard may be associated with multiple hazard conditions, such as heat and smoke, in which case different detectors may monitor different conditions. In this configuration, the pressure tube 104 and fire detector 110 provide hazard control based on a multiple possible hazard conditions. In addition, the pressure tube 104 and fire detector 110 may be configured to provide hazard detection in response to partially coextensive hazard conditions. in this configuration, the pressure tube 104 and fire detector 110 would provide substantially independent detection systems for some hazard conditions and hazard control based on a variety of input hazard conditions for other hazard conditions. Given the multiplicity of combinations of fire conditions, these examples are illustrative rather than exhaustive.

The fire detector 110 and the pressure control valve 112 may be configured in any suitable manner to facilitate communication and/or deployment. For example, in one embodiment, the fire detector 110 may include a wireless transmitter and the pressure control valve 112 may include a wireless receiver to receive wireless control signals from the fire detector 110, which facilitates remote placement of the fire detector 110 relative to the pressure control valve 112. Alternatively, the fire detector 110, pressure control valve 112, and/or other elements of the hazard detection system may be connected by hardwire connections, infrared signals, acoustic signals, and the like.

Figure 3:
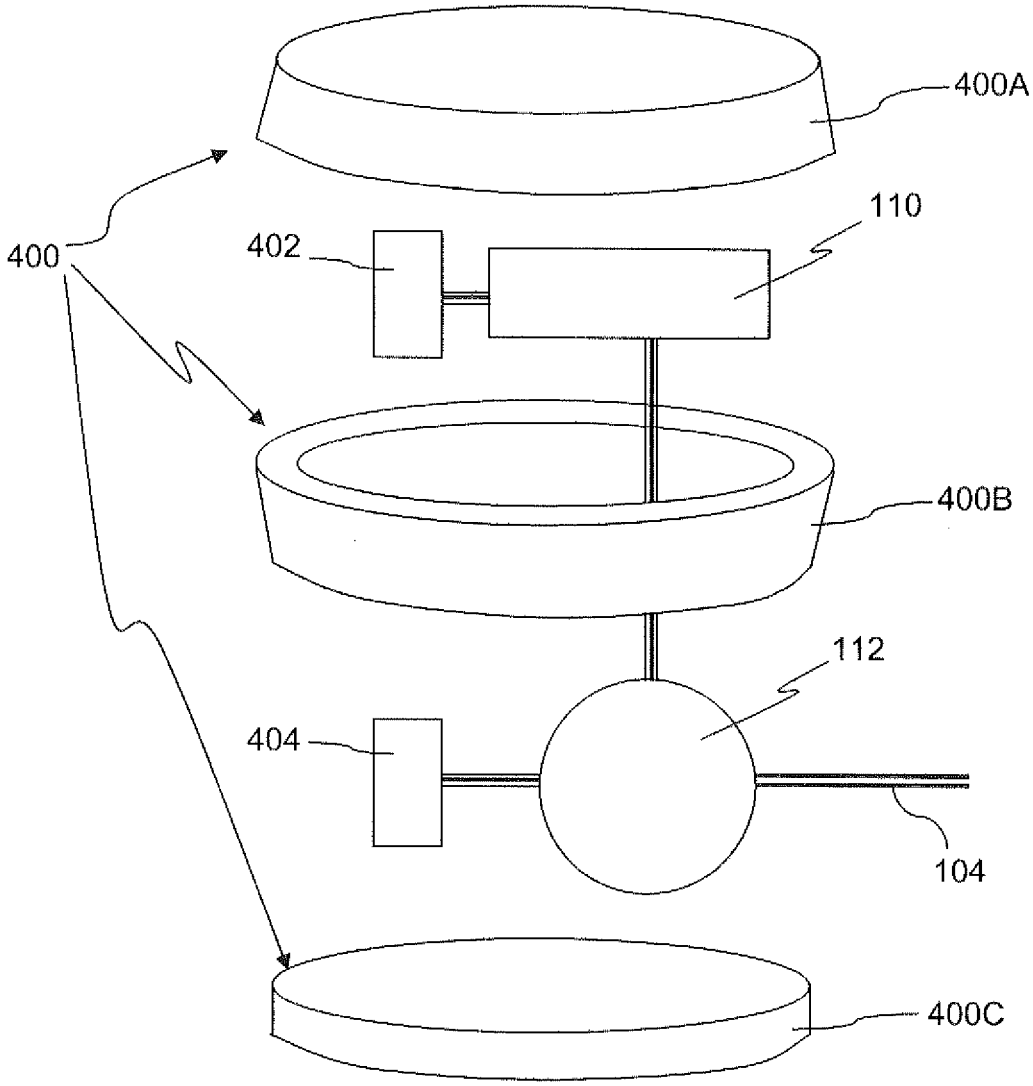
FIG. 3 is an exploded view of a hazard detection system including a housing.

Referring to FIG. 3, the fire detector 110 and pressure control valve 112 may be at least partially disposed within a housing 400 to form a single unit. The housing 400 may be configured to facilitate installation and power supply to the fire detector 110 and the pressure control valve 112. For example, the housing 400 may include an area for housing the fire detector 110, such as a conventional housing having slots or other exposure permitting the fire detector 110 to sense the ambient atmosphere. The housing 400 may further include an area for the pressure control valve 112, which may be connected to the fire detector 110 to receive signals from the fire detector 110.

The housing 400 may further be configured to substantially accommodate a portion of the pressure tube 104 to facilitate control of the pressure in the pressure tube 104 by the pressure control valve 112. For example, the housing 400 may include one or more apertures through which the end of the pressure tube 104 may be connected to the pressure control valve 112. The housing 400 may comprise various materials including aluminum, aluminum alloy, cement, ceramic, copper, copper alloy, composites, iron, iron alloy, nickel, nickel alloy, organic materials, polymer, titanium, titanium alloy, and/or the like. The housing 400 may comprise various shapes, dimensions, and coatings according to various design considerations such as corrosion, cost, deformation, fracture, and/or the like. The housing 400 may be configured lo include emissive properties with respect to ambient conditions and these properties may be achieved by including vents, holes, slats, permeable membranes, semi-permeable membranes, selectively permeable membranes, and/or the like within at least a portion of the housing 400. Further, the housing 400 may be disassembled into multiple sections 400A-400C to facilitate installation and/or maintenance.

In addition, the housing 400 may be configured to provide power to the elements of the system, such as the fire detector 110 and the pressure control valve 112. The power source may comprise any appropriates forms and source of power for the various elements. For example, the power source may include a main power source and a backup power source. In one embodiment, the main power source comprises a connection for receiving power from a conventional distribution outlet. The backup power source is configured to provide power in the event of a failure of the main power source, and may comprise any suitable source of power, such as one or more capacitors, batteries, uninterruptible power supplies, generators, solar cells, and/or the like. In the present embodiment, the backup power source includes two batteries 402, 404 disposed within the housing 400. The first battery 402 provides backup power to the fire detector 110 and the second battery 404 provides backup power to the pressure control valve 112. In one embodiment, the pressure control valve 112 requires a higher power, more expensive, and/or less reliable battery than the fire detector 110. Thus, the valve battery 404 may fail without disabling the backup power for the fire detector 110 supplied by the fire detector battery 402.

Referring again to FIG. 1, the hazard control system 100 may be further configured to operate autonomously or in conjunction with external systems, for example a fire system control unit 109 for a building or the like. The operation with the external systems may be configured in any suitable manner, for example to initiate an alarm, control the operation of the hazard control system 100, automatically notify emergency services, and/or the like. For example, the hazard control system 100 may include a communication interface connected to a remote control unit to signal the control unit 109 in response to a detected fire condition. The hazard control system 100 may be configured to respond to signals from the remote control unit 109, for example to provide status indicators for the hazard control system 100 and/or remotely activate the hazard control system 100.

The hazard control system 100 may further comprise additional elements for controlling and activating the hazard control system. For example, the hazard control system may include a manual system for manually activating the hazard control system. Referring again to FIG. 2, in the present embodiment, the hazard control system 100 includes a manual valve 202 configured for manually activating the hazard control system 100. For example, the manual valve 202 many be coupled to the pressure tube 104 such that the manual valve 202 may release the internal pressure of the pressure tube 104. The manual valve 202 may be operated in any suitable manner, such as manual manipulation of the valve or in conjunction with an actuator, such as motor or the like.

The manual valve 202 may be located in any suitable location, such as substantially outside of the hazard area 106 or within the hazard area 106. The manual valve 202 may be coupled to the vessel 102, pressure tube 104, pressure control valve 112, and/or the like. For example, the manual valve 202 may be configured for operation with the vessel 102 such that actuation of the manual valve 202 directs extinguishant to the nozzle 108. The manual valve 202 may be configured for operation with the pressure tube 104 such that actuation of the manual valve 202 causes a change in pressure within the pressure tube 104 sufficient to direct extinguishant to the nozzle 108. The manual valve 202 may further be configured for operation with the pressure control valve 112 such that actuation of the manual valve 202 causes actuation of the pressure control valve 112, causing a change in pressure within the pressure tube 104 sufficient to direct extinguishant to the nozzle 108.

The hazard control system 100 may further comprise systems for providing additional responses in the event of a hazard being detected such that the hazard control system 100 may initiate further responses in addition to delivering the extinguishant in the event that a hazard is detected. The hazard control system 100 may be configured to prompt any appropriate response, such as alerting emergency personnel, sealing off an area from unauthorized personnel, terminating or initiating ventilation of an area, deactivating hazardous machinery, and/or the like. For example, the hazard control system 100 may comprise a supplementary pressure switch 302. The supplementary pressure switch 302 may facilitate transmitting information relating to changes in pressure within the pressure tube 104 to external systems, such as be generating an electrical signal, mechanical signal, and/or other suitable signal in response to a pressure change within the coupled pressure tube 104.

In one embodiment, the supplementary pressure switch 302 may be coupled to machinery in the vicinity of the hazard area 106 to cut power or fuel supply to the machinery in the event that the supplementary pressure switch 302 produces a signal indicating a hazard condition as detected by the hazard control system 100.

In other embodiments, the hazard control system 100 may be configured with multiple vessels 102, pressure tubes 104, nozzles 108, pressure control valves 112, hazard detectors 110, manual valves 202, and/or supplementary pressure switches 302. For example, the hazard control system 100 may be configured to include multiple vessels 102 coupled to a single nozzle 108 and hazard detector 110, such as if controlling the hazard area 106 includes drawing multiple types of extinguishant which cannot be stored together, or if the extinguishing anticipated hazards may require different extinguishants to be applied at different times. As another example, the hazard control system 100 may be configured to include more than one pressure tube 104 coupled to a single nozzle 108 and hazard detector 110, for example to provide multiple paths for delivering the extinguishant, or to draw different extinguishants in response to different fire conditions. Given the multiplicity of combinations of elements, these examples are illustrative rather than exhaustive.

Figure 4:
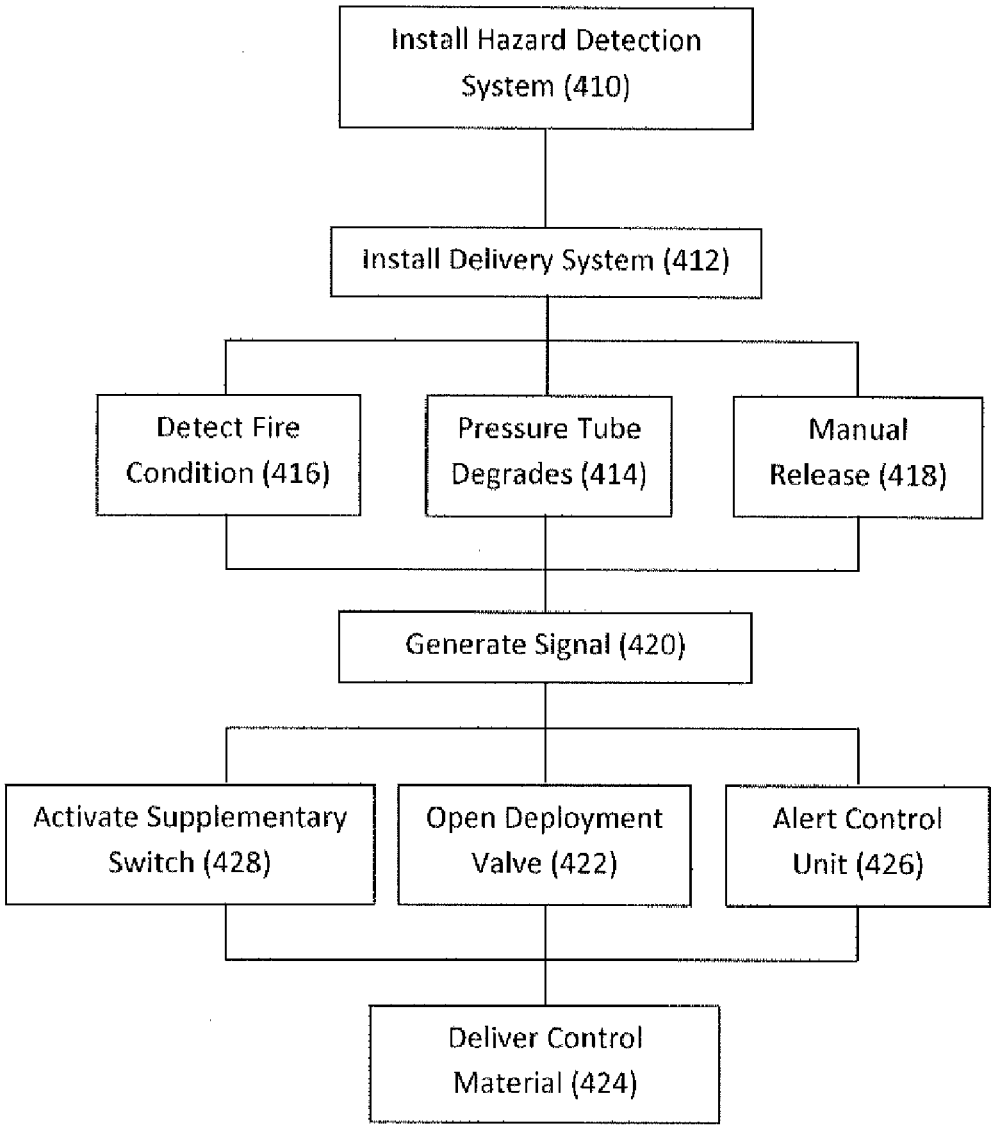
FIG. 4 is a flow diagram of a process for controlling a hazard.

Referring to FIG. 4, in operation, the hazard control system 100 is initially configured such that the hazard detection system 105 may sense relevant indicators of hazard conditions (410). For example, the pressure tube 104 may be exposed to the interior of a room or other enclosure so that in the event of a fire, the pressure tube 104 is exposed to heat from the fire. Likewise, relevant sensors, such as the fire detector 110, may be positioned to sense relevant phenomena should a hazard occur. The delivery system 107 is also suitably configured to deliver a control material to areas where a hazard may occur (412).

When a hazard occurs, the hazard detection system may detect the hazard and activate the hazard control system 100. For example, the heat of a fire may degrade the pressure tube 104 (414), causing the interior pressure of the pressure tube 104 to be released, thus generating a pneumatic signal (420). In addition, a sensor, such as a smoke detector, may sense smoke or another relevant hazard indicator (416) and activate the hazard control system 100. For example, the sensor may open the pressure control valve 112, likewise releasing the pressure in the pressure tube 104 and generating the pneumatic signal. Further, the signal may be generated by other systems, such as an external system or the manual valve 202 (418).

The signal is received by the deployment valve, which opens (422) in response to the signal to deliver the control material. The control material is dispensed through the delivery system into the area of the hazard (424), thus tending to control the hazard. The signal may also be received and/or transmitted to other systems, such as the control unit (426) and/or the supplementary pressure switch 302 (428).

These and other embodiments for methods of controlling a hazard may incorporate concepts, embodiments, and configurations as described with respect to embodiments of apparatus for controlling a hazard as described above. The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The invention has been described with reference to specific exemplary embodiments. Various modifications and changes, however, may be made without departing from the scope of the present invention. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of-permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to a preferred embodiment. However, changes and modifications may be made to the preferred embodiment without departing from the scope of the present invention. These and other changes or modifications are intended to be included within the scope of the present invention, as expressed in the following claims.

The invention claimed is:

1. A fire control system configured to deliver an extinguishant in response to a pneumatic signal, comprising:

a pressure tube adapted to have an internal pressure, wherein at least a portion of the pressure tube is configured to leak in response to exposure to heat, wherein the leak changes the internal pressure and generates the pneumatic signal;

a valve coupled to the pressure tube, wherein the valve is configured to change the internal pressure and generate the pneumatic signal in response to a detection signal; and a detector coupled to the valve and configured to generate the detection signal in response to a detection of a fire condition.

2. A fire control system according to claim 1, further comprising a manually-operated valve coupled to the pressure tube.

3. A fire control system according to claim 1, further comprising a housing, wherein the housing contains at least a portion of the detector and the valve.

4. A fire control system according to claim 3, wherein the housing at least partially contains:

a power supply connection connected to the detector;

a first battery connected to the detector; and a second battery connected to the valve.

5. A fire control system according to claim 3, wherein:

the housing has a hole defined therethrough; and the pressure tube is disposed through the hole to couple to the valve.

6. A fire control system according to claim 1, further comprising a switch coupled to the pressure tube, wherein the switch is further configured to generate an electrical signal in response to a change in the internal pressure of the pressure tube.

7. A fire control system, comprising:

a vessel configured to store an extinguishant;

a pressure tube adapted to have an internal pressure, wherein at least a portion of the pressure tube is configured to leak in response to exposure to a selected temperature;

a fire detector configured to generate a signal in response to a detection of a fire condition;

a nozzle coupled to the vessel and the pressure tube, wherein the nozzle is configured to selectively transmit the extinguishant in response to a change in the internal pressure of the pressure tube; and a valve coupled between the fire detector and the pressure tube, wherein the valve is configured to change the internal pressure in the pressure tube in response to the signal from the fire detector.

8. A fire control system according to claim 7, further comprising a manually-operated valve coupled to the pressure tube.

9. A fire control system according to claim 7, further comprising a housing, wherein the housing contains at least a portion of the fire detector and the valve.

10. A fire control system according to claim 9, wherein the housing at least partially contains:

a power supply connection connected to the fire detector;

a first battery connected to the fire detector; and a second battery connected to the valve.

11. A fire control system according to claim 9, wherein:

the housing has a hole defined therethrough; and the pressure tube is disposed through the hole to couple to the valve.

12. A fire control system according to claim 7, further comprising a switch coupled to the pressure tube, wherein the switch is further configured to generate an electrical signal in response to a change in the internal pressure of the pressure tube.

13. A method for forming a fire control system, comprising:

providing a vessel configured to store an extinguishant;

providing a pressure tube configured to operate having an internal pressure, wherein at least a portion of the pressure tube is configured to leak in response to a first fire condition;

providing a fire detector configured to generate a signal in response to a second fire condition;

coupling a nozzle to the vessel and the pressure tube, wherein the nozzle is configured to selectively transmit the extinguishant in response to a change in the internal pressure of the pressure tube; and coupling a valve to the fire detector and the pressure tube, wherein the valve is configured to change the internal pressure in the pressure tube in response to a signal from the fire detector.

14. A method according to claim 13, further comprising coupling a manually-operated valve coupled to the pressure tube.

15. A method according to claim 13, further comprising providing a housing, wherein the housing contains at least a portion of the fire detector and the valve.

16. A method according to claim 15, wherein the housing at least partially contains:

a power supply connection connected to the fire detector;

a first battery connected to the fire detector; and a second battery connected to the valve.

17. A method according to claim 13, further comprising coupling a switch to the pressure tube, wherein the switch is further configured to generate a signal in response to a change in the internal pressure of the pressure tube.

18. A method according to claim 15, wherein the housing has a hole defined therethrough, and further comprising:

disposing the pressure tube through the hole; and coupling the pressure tube to the valve.

* * * * *